US006040102A

United States Patent [19]

Takahashi et al.

[11] Patent Number: 6,040,102

[45] Date of Patent: Mar. 21, 2000

[54] ELECTROSTATIC LATENT IMAGE DEVELOPER AND IMAGE FORMING METHOD

[75] Inventors: Sakon Takahashi; Shinpei Takagi; Noriyuki Mizutani; Yasuhiro Oya; Haruhide Ishida, all of Minami-Ashigara, Japan

[73] Assignee: Fuji Xerox Co., Ltd., Tokyo, Japan

[21] Appl. No.: 08/982,301

[22] Filed: Dec. 1, 1997

[30] Foreign Application Priority Data

Dec. 5, 1996 [JP] Japan ..... 8-325136

[51] Int. Cl.[7] ..... G03G 9/113

[52] U.S. Cl. ..... 430/108; 430/110; 430/97

[58] Field of Search ..... 430/108, 110, 430/97

[56] References Cited

U.S. PATENT DOCUMENTS

| | | | |
|---|---|---|---|
| 5,372,905 | 12/1994 | Deusser et al. | 430/110 |
| 5,429,902 | 7/1995 | Saito et al. | 430/110 |
| 5,604,071 | 2/1997 | Okado et al. | 430/110 |
| 5,670,289 | 9/1997 | Hanzlik et al. | 430/110 |

FOREIGN PATENT DOCUMENTS

| | | |
|---|---|---|
| 56-75659 | 6/1981 | Japan . |
| 5-61271 | 3/1993 | Japan . |
| B2-7-31422 | 4/1995 | Japan . |
| B2-7-120086 | 12/1995 | Japan . |

*Primary Examiner*—Christopher D. Rodee
*Attorney, Agent, or Firm*—Oliff & Berridge, PLC

[57] ABSTRACT

An electrostatic latent image developer including a toner, which is formed from an outer additive and non-magnetic resin particles containing a binder resin and a coloring agent, and a carrier, in which a resin coating layer in which electroconductive fine powder is dispersed in a matrix resin is formed on a core, wherein a volume specific resistivity of said carrier is greater than or equal to $10^9$ Ω·cm at an electric field strength of 3000 V/cm and is less than or equal to $10^{13}$ Ω·cm at an electric field strength of 10000 V/cm, said outer additive contains titanium oxide whose volume specific resistivity of a compression-molded molded product is greater than or equal to $10^6$ Ω·cm at an electric field strength of 3000 V/cm and is less than or equal to $10^{10}$ Ω·cm at an electric field strength of 10000 V/cm, and a volume specific resistivity of said electrostatic latent image developer when a toner concentration is greater than or equal to 2% is greater than or equal to $10^{11}$ Ω·cm at an electric field strength of 3000 V/cm.

Further, the present invention provides an image forming method including steps of forming a latent image on a latent image holding member, and developing the latent image by using said electrostatic latent image developer.

19 Claims, 3 Drawing Sheets

ELECTROSTATIC LATENT IMAGE DEVELOPER AND IMAGE FORMING METHOD

BACKGROUND OF THE INVENTION

1. Field of the Invention

The present invention relates to an electrostatic latent image developer and an image forming method used for developing an electrostatic latent image in electrophotography and electrostatic recording.

2. Description of the Related Art

A method for visualizing image information through an electrostatic latent image such as an electrophotography method and the like is currently used in various fields. In the electrophotography method, a latent image is formed on a photosensitive member as a latent image holder by a charging process and an exposing process, the latent image is visualized in a developing process, and a toner image visualized via a transferring process and a fixing process is fixed on an image recording body such as paper and the like. As a developing method in the developing process, a cascade method and the like have formerly been used, and recently, a magnetic brush method has become the most common method. This method uses a magnetic roll as a member for transporting a developer since it is excellent in reproduction not only of a line image but also a solid image and a continuous gradation.

The electrostatic latent image developers used in the developing process are widely classified into two-component developer comprises a toner and a carrier, and single-component developers comprises only a toner. The two-component developer is currently widely used due to its excellent controllability obtained through the functions of an electrostatic latent image developer being separately performed by the toner and the carrier.

Generally the carriers in the two-component developer are largely divided into coated carriers in which a resin-coated layer is formed on the surface of a magnetic powder such as iron, ferrite, magnetite and the like, and into non-coated carriers in which no resin-coated layer is formed on the surface of a magnetic powder. This coated carrier is often used due to the excellent controllability of electric resistivity and the long life span of the developer, and various types of coated carriers have been developed and used in practical applications.

On the other hand, the toners are usually composed of additives and non-magnetic resin particles containing a binding resin, a coloring agent and a releasing agent, and in the case of a black toner, carbon black is usually used as the coloring agent. The additives are used to prevent a decrease in adhesion between the toner and the carrier, to prevent flocculation of the toner, to improve toner flowability, to control static electricity, and the like. They are dispersed on the surface of non-magnetic resin particles. Further, metal oxide particles are usually used as additives, and a surface treatment such as hydrophobitization and the like is effected on the particle to control the electrostatic properties, environmental stability, resistivity and the like.

The raw material, characteristics, structure, composition and the like of the toner and carrier used in two-component developer are selected depending on conditions in the developing apparatus such as the electric field, transportation, magnetic field, stress and the like.

In the developing method using a two-component developer, it is usual to rotate a magnetic roll and photosensitive member in a forward direction and make the circumferential speed of the magnetic roll faster than that of the photosensitive member, in order to guarantee sufficient image density, namely, in order to supply sufficient electrostatic latent image developer in the developing area. However, in this method, developing defects occur due to the difference in relative speeds between the magnetic roll and the photosensitive body, for example, the rear edge of a solid image being left void, and the rear edge of a half tone image in the border region between the front edge of a solid image and the half tone being left void in cases when the half tone and the solid image simultaneously exist. These image voids occur since changes in the amount of electric potential in the electrostatic latent image developer layer, arising from movement of the toner in the developing nip area, depend on the latent image structure. In the above-described method, it is supposed that, since the area to be developed is developed by using an electrostatic latent image developer which has received the influence of the electric field of the area directly in front of this area, the above-described defects are noticeable in areas where the latent image is non-continuous, for example, the border between a solid image part and a part with no image, or the border between half tone and a solid image.

As an example of has to improve these defects, suppressing the volume specific resistivity of a carrier at low levels is suggested in Japanese Patent Application Laid-Open (JP-A) No. 5-61271, Japanese Patent Application Publication (JP-B) Nos. 7-31422, 7-120086 and the like. Further, to lower the volume specific resistivity of a carrier, a method in which the surface of a magnetic powder is coated with a resin to which an electroconductive component is added, is suggested in Japanese Patent application Laid-Open (JP-A) No. 56-75659 and the like.

However, the inventions described in the aforementioned publications do not prevent carrier-over caused by the injection of an electric charge into a carrier, or what are called brush marks which are caused by the generating of latent image leaks, or lowering the ability to supply toner to a photosensitive body due to the proximity of a developing effective electrode to the photosensitive body, and the like, which occur when the volume specific resistivity of a carrier is excessively lowered.

Further, in the inventions described in the aforementioned publications, fogging caused by the injection of electric charge occurs, depending on the toner used, even when a carrier having volume specific resistivity in the range which does not cause the above-described defects in an electrostatic latent image developer is used. This phenomenon has become more remarkable through the use of carriers having volume specific resistivity in the range which does not cause the above-described defects, or through the use of developing systems in which AC bias and DC bias are used simultaneously.

SUMMARY OF THE INVENTION

Therefore, in consideration of the above-described facts, the object of the present invention is to provide an electrostatic latent image developer and an image forming method which can solve these problems.

The present inventors have paid attention to the respective volume specific resistivities of carriers, toners and electrostatic latent image developers to improve the above-described defects in the conventional techniques.

The volume specific resistivity of a coated carrier varies depending on the measured electric field. In low electric fields, electric insulation from the resin-coated layer is indicated, while in high electric fields, electroconductivity from the magnetic particles is indicated. Therefore, when the volume specific resistivity of a coated carrier is stipulated, the electric field measured must also be stipulated.

The volume specific resistivity of a toner is determined by the volume specific resistivities of the non-magnetic resin particles and additives and by the amount of the additives. The volume specific resistivity of the non-magnetic resin particles is governed by the amount of electroconductive fine particles (in the case of black toner, this is mainly carbon black) contained in the particles. Further, it is known that kind, the type, as well as the dispersal conditions and the like of the electroconductive fine particles also exerts an influence on the volume specific resistivity of the toner. Further, the volume specific resistivity of an additive varies depending on the core resistivity of the additive and on the amount of surface processing.

Further, the volume resistivity of a two-component developer containing a carrier and a toner, is related to the toner concentration TC (100×toner weight/carrier weight), and the lower the toner concentration, the lower the volume resistivity of an electrostatic latent image developer.

The present inventors in consideration of the above-described facts, have tried various combinations of carriers, non-magnetic resin particles, and additives, and investigated the effects of different toner concentrations on the volume specific resistivity of the carrier and additive, and on the volume resistivity of the electrostatic latent image developer, as well as the influence of these volume specific resistivities, volume resistivities, and toner concentrations on the quality of an image.

As a result, the present inventors have found that the volume specific resistivity when the electric field strength is in the range of from 3000 V/cm to 10000 V/cm which is applied to an electrostatic latent image developer in actual developing, has the strongest correlation to the developing properties, and influence on the quality of an image.

Further, it has been found that when toner concentration is high, almost no defects in the quality of an image occur from using a carrier having a specific volume specific resistivity, however, when the toner is consumed as time elapses, and the toner concentration lowers to a certain level, the above-described defects can not be prevented merely by stipulating the volume specific resistivity of the carrier.

The present inventors have completed the present invention based on the above-described research results.

The present invention is an electrostatic latent image developer including a toner, which is formed from an outer additive and non-magnetic resin particles containing a binder resin and a coloring agent, and a carrier, in which a resin coating layer in which electroconductive fine powder is dispersed in a matrix resin is formed on a core, wherein a volume specific resistivity of said carrier is greater than or equal to $10^9$ Ω·cm at an electric field strength of 3000 V/cm and is less than or equal to $10^{13}$ Ω·cm at an electric field strength of 10000 V/cm, said outer additive contains titanium oxide whose volume specific resistivity of a compression-molded molded product is greater than or equal to $10^6$ Ω·cm at an electric field strength of 3000 V/cm and is less than or equal to $10^{10}$ Ω·cm at an electric field strength of 10000 V/cm, and a volume specific resistivity of said electrostatic latent image developer when a toner concentration is greater than or equal to 2% is greater than or equal to $10^{11}$ Ω·cm at an electric field strength of 3000 V/cm.

Further, the present invention provides an image forming method including steps of forming a latent image on a latent image holding member, and developing the latent image by using an electrostatic latent image developer, in which the electrostatic latent image developer is above-described electrostatic latent image developer.

DESCRIPTION OF THE PREFERRED EMBODIMENTS

Figure 1:
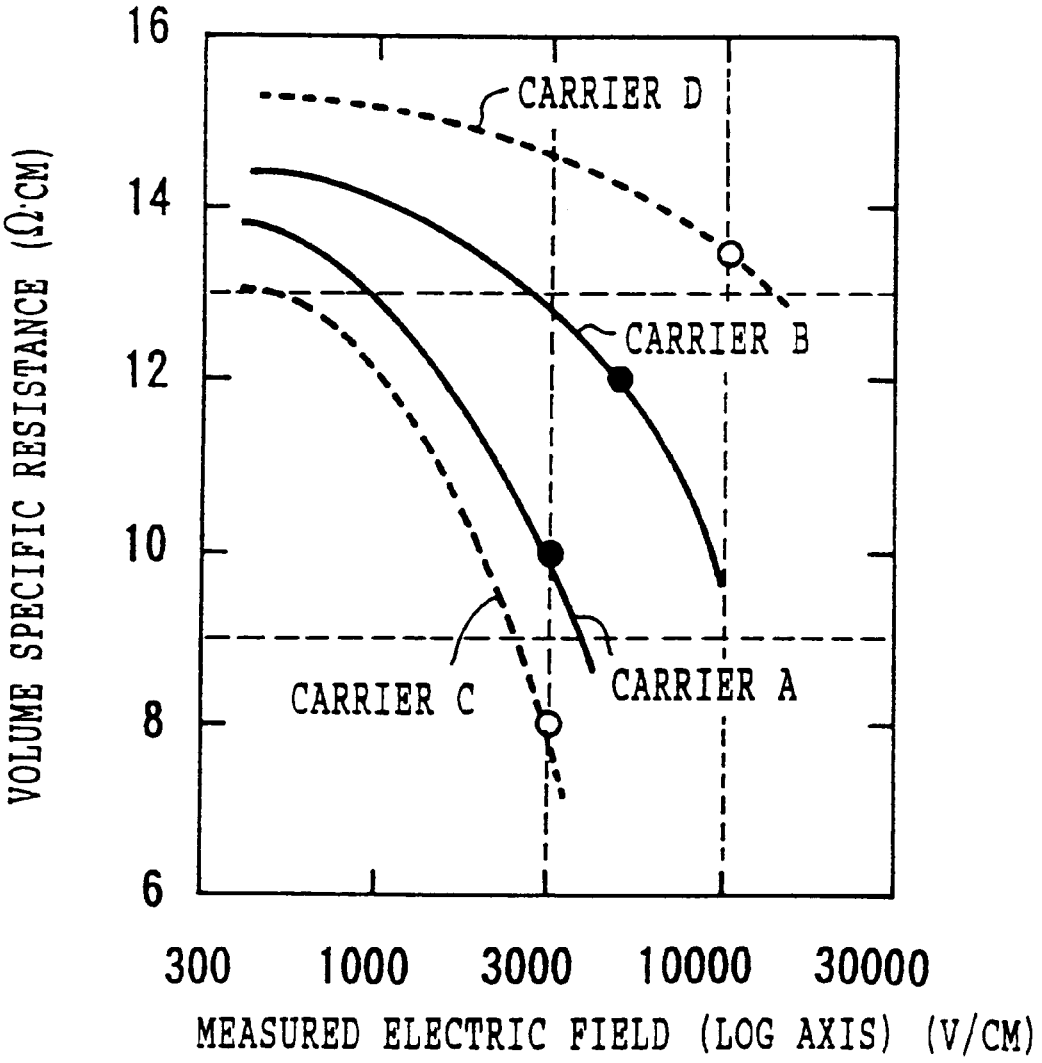
FIG. 1 is a graph showing the relation between the volume specific resistivity of a carrier and the measured electric field.

The electrostatic latent image developer of the present invention comprises a toner and a carrier, the carrier being a coated carrier obtained by forming on a core material a resin-coated layer obtained by dispersing an electroconductive fine particle in a matrix resin.

The core material for the carrier which can be used in the present invention is not particularly restricted, and examples thereof include magnetic metals such as iron, steel, nickel, cobalt and the like, and magnetic oxides such as ferrite, magnetite and the like. The average particle size of the carrier core material is usually from 10 μm to 150 μm, and preferably from 30 μm to 100 μm.

The matrix resin can be selected from all resins which can be used as a resin-coated layer for a carrier in the field. Specific examples there of include polyolefin-based resins, such as polyethylene and polypropylene; polyvinyl and polyvinylidene-based resins, such as polystyrene, acrylic resins, polyacrylonitrile, polyvinyl acetate, polyvinyl alcohol, polyvinyl butyral, polyvinyl chloride, polyvinyl carbazole, polyvinyl ether and polyvinyl ketone; vinyl chloride-vinyl acetate copolymers; styrene-acrylic acid copolymers; straight silicone resins composed of organosiloxane couplings or modified products thereof; fluorine resins such as polytetrafluoroethylene, polyvinyl fluoride, and polyvinylidene fluoride, polychlorotrifluoroethylene; polyesters; polyurethanes; polycarbonates; phenol resins; amino resins such as urea-formaldehyde resin, melamine resin, benzoguanamine resin, urea resin, and polyamide resin; epoxy resins, and the like. These resins may be used alone or in combinations of two or more.

The electroconductive fine particles are used to lower the volume specific resistivity of the carrier, and examples thereof include metals such as gold, silver and copper; carbon black; semiconductive oxides such as titanium oxide and zinc oxide; coated particles obtained by coating the surface of particles of titanium oxide, zinc oxide, barium sulfate, aluminum borate, potassium titanate and the like with tin oxide, carbon black and metal, and the like. Among these, carbon black is preferable because of its excellent production stability, cost and electroconductivity. The type of carbon black is not particularly restricted, with any carbon black able to be used, however, a carbon black which has excellent stability in production having a DBP (dibutyl phthalate) oil absorption level of 50 to 300 ml/100 g is preferable. The average particle size of the electroconductive fine particles is preferably not more than 0.1 μm, and for dispersibility, the primary particle size is preferably not more than 50 nm.

When the resin-coated layer is to be endowed with various functions, resin fine particles corresponding to those functions can be added to the resin-coated layer. For example, to improve the mechanical strength of the carrier using resin fine particles, thermoplastic resin particles and thermosetting resin particles having a higher hardness than the matrix resin can be used. Since the hardness of the thermosetting resin particles is easily raised and it is already in the form of a fine particle in a solvent, the thermosetting resin particles are easily dispersed in coating, do not flocculate, and can maintain the form of the primary particle in the resin-coated layer. Further, when the toner is to be endowed with negative charge imparting and charge maintaining properties, resin particles containing nitrogen as a charge controlling agent can be used.

Specific examples of thermoplastic resins which can be used in the resin fine particles include polyolefin-based resins, such as polyethylene, and polypropylene; polyvinyl and polyvinylidene-based resins, such as polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone; vinyl chloride-vinyl acetate copolymers; styrene-acrylic acid copolymers; straight silicone resins composed of organosiloxane couplings or modified products thereof; fluorine resins such as polytetrafluoroethylene, polyvinyl fluoride, polyvinylidene fluoride, and polychlorotrifluoroethylene; polyesters; polycarbonates, and the like.

Examples of thermosetting resins which can be used in the resin fine particles include phenol resins; amino resins such as urea-formaldehyde resin, melamine resin, benzoguanamine resin, urea resin, and polyamide resin; epoxy resins and the like.

The average particle size of the resin fine particles is preferably from 0.05 to 2 $\mu$m, and more preferably from 0.1 to 1 $\mu$m. When the average particle size of the resin fine particles is not more than 0.05 $\mu$m, dispersion in the resin-coated layer is poor, and when over 2 $\mu$m, the particles are easily removed from the resin-coated layer, and the natural function can not be maintained.

The amount of coating resin of the resin-coated layer considering the maintaining ability, charge imparting ability, pollution resistivity, environmental stability and the like of the carrier, is preferably not less than 1 part by weight and not more than 15 parts by weight based on 100 parts by weight of a carrier. When the amount of the coating resin is less than 1 part by weight, a lowering of environmental stability caused by the core material being exposed, and a lowering of the charge amount caused by the toner adhering to the core material occurs. Since the charge capacity of a carrier is related to the amount of coating resin, the charge maintaining ability is also improved by increasing the amount of the coating resin. However, when the amount of the coating resin is over 15 parts by weight, the carrier undesirably flocculates.

To form the above-described resin-coated layer on the surface of a core material, a solution (a matrix resin, resin fine particles, and electroconductive fine particle are contained in a solvent) for forming a resin-coated layer is typically used. Specific examples include an immersion method in which a powder of a core material is immersed in a solution for forming a resin-coated layer, a spray method in which a solution for forming a resin-coated layer is sprayed on the surface of a core material, a fluid bed method in which a solution for forming a resin-coated layer is sprayed onto a core material which is kept floating by a moving current of air, and a kneader coater method in which a carrier core material and a solution for forming a resin-coated layer are mixed in a kneader coater and the solvent is removed, and in the present invention, the kneader coater method is preferably used.

The solvent used in the solution for forming a resin-coated layer is not particularly restricted provided it dissolves a matrix resin, and examples thereof include aromatic hydrocarbons such as toluene, xylene, and the like, ketones such as acetone, methyl ethyl ketone, and the like, ethers such as tetrahydrofuran, dioxane, and the like, The volume specific resistivity of a carrier produced as described above is required to be $10^9\Omega\cdot$cm or more at an electric field strength of 3000 V/cm and $10^{13}\Omega\cdot$cm or less at an electric field strength of 10000 V/cm, and preferably $10^{11}\Omega\cdot$cm or more at an electric field strength of 3000 V/cm and $10^{12}\Omega\cdot$cm or less at an electric field strength of 10000 V/cm. When the volume specific resistivity of the carrier is less than $10^9\Omega\cdot$cm at an electric field strength of 3000 V/cm, toner fogging and adhesion of the carrier to the photosensitive member caused by the injection of a charge occurs, and when the volume specific resistivity of the carrier is over $10^{13}\Omega\cdot$cm at an electric field strength of 10000 V/cm, defects in image quality occur.

On the other hand, a toner which can be used in the present invention is composed of an additive and non-magnetic resin particles containing a binding resin and coloring agent.

Examples of the adhesive resin used in the toner include homopolymers and copolymers of styrenes such as styrene, chlorostyrene, and the like; monoolefines such as ethylene, propylene, butylene, isoprene, and the like; vinyl esters such as vinyl acetate, vinyl propionate, vinyl benzoate, vinyl acetate, and the like; $\alpha$-methylene aliphatic monocarboxylates such as methyl acrylate, ethyl acrylate, butyl acrylate, dodecyl acrylate, ocryl acrylate, phenyl acrylate, methyl methacrylate, ethyl methacrylate, butyl methacrylate, dodecyl methacrylate, and the like; vinyl ethers such as vinyl methyl ether, vinyl ethyl ether, vinyl butyl ether, and the like; vinyl ketones such as vinyl methyl ketone, vinyl hexyl ketone, vinyl isopropenyl ketone, and the like. Further, polyester, polyurethane, epoxy resin, silicon resin, polyamide, modified rosin, paraffin and waxes are listed. Among them, typical adhesive resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester, and the like, and polyester is particularly preferable. Specific examples of polyesters include linear polyester resins composed of a polycondensate containing as a main monomer component bisphenol A and polyvalent aromatic carboxylic acid, and polyesters containing a THF insoluble component in an amount from 5 to 30% is particularly preferred. Further, a polyester having a softening point from 90 to 150° C., a glass transition point from 50 to 70° C., a number average molecular weight from 2000 to 6000, a weight average molecular weight from 8000 to 150000, an acid value from 5 to 30, and a hydroxyl value from 5 to 40 can also be used.

Examples of the coloring agent include carbon black, nigrosine dye, aniline blue, chalcoyl blue, chrome yellow, ultramarine blue, dupont oil red, quinoline yellow, methylene blue chloride, phthalocyanine blue, malachite green·oxalate, lamp black, rose bengal, C. I. Pigment·red 48:1, C. I. Pigment·red 122, C. I. Pigment·red 57:1, C. I. Pigment·yellow 97, C. I. Pigment·yellow 12, C. I.

Pigment·blue 15:1, C. I. Pigment·blue 15:3, magnetite, ferrite, and the like. In the case of a black toner, carbon black is preferably used, and the type thereof is not particularly restricted and publicly-known products can be used. In particular, a carbon black which has excellent stability in production having a DBP (dibutyl phthalate) oil absorption level of from 50 to 300 ml/100 g is preferable. In the case of carbon black, the average particle size thereof is preferably not more than 0.1 $\mu$m, and for dispersion, the primary particle size is preferably not more than 50 nm.

The percentage content of the coloring agent in the non-magnetic resin particle may be optionally determined, and when the coloring agent is carbon black, the percentage content of carbon black in the non-magnetic resin particle is preferably in the range of from 2 to 10% by weight. When the percentage content of carbon black in the non-magnetic resin particles is more than 10%, resistivity of the toner decreases and fogging occurs due to induction of a charge. When the percentage content of carbon black in the non-magnetic resin particles is less than 2%, a decrease in solid concentration, an increase in toner consumption, and a deterioration of responsiveness in adding toner due to an increase of resistivity occur.

The non-magnetic resin particles may optionally contain publicly known additives such as a charge controlling agent, a fixing aid, and the like.

The volume specific resistivity of the non-magnetic resin particles can be represented, for example, by the dielectric loss tangent tanδ. The value of tanδ is generally in the range from 3 to 15. When tanδ is less than 3, dispersion of the coloring agent is poor, therefore coloring ability falls, and charge unevenness between toners increases, consequently, pollution easily occurs in the apparatus. On the other hand, when tanδ is over 15, charge injection fogging tends to occur. The value of tanδ is preferably from 3 to 12, and more preferably from 4 to 8.

The additive in the present invention contains titanium oxide with the volume specific resistivity of a molded article thereof obtained by compression molding being $10^6\Omega\cdot$cm or more at an electric field strength of 3000 V/cm and $10^{10}\Omega\cdot$cm or less at an electric field strength of 10000 V/cm. When the volume specific resistivity is less than $10^6\Omega\cdot$cm at an electric field strength of 3000 V/cm, charge injection fogging tends to occur, and when the volume specific resistivity is over $10^{10}\Omega\cdot$cm at an electric field strength of 10000 V/cm, the amount of surface processing material increases and flowability deteriorates. It is preferable that the volume specific resistivity of a molded article of titanium oxide obtained by compression molding is $10^6\Omega\cdot$cm or more at an electric field strength of 3000 V/cm and $10^9\Omega\cdot$cm or less at an electric field strength of 10000 V/cm.

Further, the ratio of the above-described titanium oxide in the additive of the present invention is preferably 0.05% by weight or more, and more preferably 0.1% by weight or more.

The volume specific resistivity of the titanium oxide can be controlled mainly by surface processing. A silane coupling agent is particularly preferable as the surface processing agent since it prevents lowering of the titanium oxide charge, improves the maintaining property thereof, and enables production of a high quality image having little fogging and excellent charge exchange properties.

Typical examples of such a silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetoamide, N,N-bis(trimethylsilyl)urea, tert-butyldimethylchlorosilane, vinyltrichlorosilane, vinyltrimethoxysilane, vinyltriethoxylsilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxyxilane and γ-chloropropyltrimethoxysilane.

As another additive which can be used together with the above-described titanium oxide, hydrophobic silica which has a low resistivity and does not easily which inhibits the occurrence of fogging caused by charge injection, and the like are listed.

To adhere the additive to the surface of the non-magnetic resin particle, both components are mixed by a high speed mixer such as, for example, a Henschel mixer, a V type blender and the like.

The amount added of titanium oxide based on 100 parts by weight of the non-magnetic resin particles is preferably from 0.2 to 3.0 parts by weight. When the amount added is less than 0.2 parts by weight, flowability of the electrostatic latent image developer deteriorates, and adhesion of the toner to the carrier and adhesion between toners easily occurs. On the other hand, if the amount added is over 3.0 parts by weight, deterioration of the electrostatic latent image developer occurs due to adhesion of the titanium oxide to the carrier and adhesion of free titanium oxide to the photosensitive member.

For mixing the toner and the carrier, a tumbler mixer, a V type mixer, and the like can be used. The toner concentration in the mixing ratio of the toner and the carrier is usually from 1 to 15%, and when developing properties and transporting properties are taken into consideration, preferably from 2% to 13%. When the toner concentration is less than 1%, deleterious effects on image quality occur such as unevenness in the solid part caused by a decrease in the amount of toner being transported, blurred letters, deterioration of half tone density reproduction, and the like. When the toner concentration is 15% or more, transportation defects occur such as blowing out, blotting, overflowing and the like of the toner due to the increase in the amount of toner transported. Further, charge defects occur such as the spreading of the charge distribution, the generation of a reverse charged toner due to frictional electrification between the toners, and the like.

The volume resistivity of the electrostatic latent image developer is required to be $10^{11}\Omega\cdot$cm or more when the toner concentration is 2% or more and the electric field strength is 3000 V/cm. When the volume resistivity is less than $10^{11}\Omega\cdot$cm, charge injected fogging occurs. The volume resistivity is preferably $10^{13}\Omega\cdot$cm or more.

The above-described electrostatic latent image developer is extremely effective in the image forming method comprising the process of forming a latent image on a latent image holding member, and developing the latent image using an electrostatic latent image developer, especially in the image forming method using reverse development and A/C bias, and consequently, an electrophotographic image having a good image quality which has no fogging, is clear, and has excellent half tone reproducibility can be maintained for long period of time.

EXAMPLES

The following examples further illustrate the present invention.

In the examples and comparative examples, the volume specific resistivity of a carrier was measured as described below.

A carrier is placed so as to form a flat layer having a thickness from about 1 mm to 3 mm on a lower pole plate of a measuring instrument composed of a pair of 20 $cm^2$ circular pole plates (steel) connected to an electro meter (trade name: KEITHLEY 610C, manufactured by KEITHLEY Corp.) and a high voltage current source (trade name: FLUKE 415B, manufactured by FLUKE Corp.). Then, the upper pole plate is placed on the carrier, a load of 4 kg is applied on the upper pole plate to remove the gap therebetween. In this condition, the thickness of the carrier layer is measured. Then, voltage is applied to both pole plates and the current value is measured. The volume specific resistivity is then calculated according to the following formula.

volume specific resistivity=applied voltage×20÷(current value−initial current value)÷carrier thickness In the above-described formula, the initial current valued is the current value when the applied voltage is 0, and the current value represents the measured current value.

The measured electric field is changed by changing the applied voltage, and a graph showing the relation between the measured electric field and the volume specific resistivity is obtained.

The volume resistivity of the electrostatic latent image developer is also measured according to the above-described manner.

For measuring the volume specific resistivity of titanium oxide, a molded article (with an are of 20 $cm^2$ or less) in the form of a disc having a thickness of about 2 to 4 mm obtained by applying a load of about 20 t to titanium oxide by a compression molding machine is used. Since the titanium oxide is in the form of fine particles, control of the thickness is difficult, with large numbers of gaps being formed, and the like. This is clamped by the above-described measuring instrument and the current value is measured in the same manner as described above. For calculating the volume specific resistivity, the following equation was used.

volume specific resistivity=applied voltage×disk area÷(current value−initial current valued)÷disk thickness

Production of Carrier

Carrier A

| | (parts by weight) |
|---|---|
| Ferrite particle (average particle size 50 μm) | 100 |
| Toluene | 14 |
| Styrene-methyl methacrylate copolymer (copolymerization ratio = 20:40, critical surface tension 35 dyne/cm) | 1.5 |
| Carbon black (trade name:R330R manufactured by Cabbot, average particle size 25 nm, DBP value 71 ml/100 g.) | 0.4 |
| Cross-linked melamine resin particle (average particle size 0.3 μm, insoluble in toluene) | 0.2 |

The above-described components except the ferrite particles were dispersed for 30 minutes by a sand mill, and a solution for forming a resin-coated layer was prepared. Then, this solution for forming a resin-coated layer was charged together with the ferrite particles in a vacuum deaeration type kneader, stirred for 30 minutes at a temperature of 70° C., then the pressure was reduced to distill off the toluene to obtain carriers comprising ferrite particles having a resin-coated layer formed thereon. The volume specific resistivity of the resulting carrier was measured by the above-described measuring method, and a graph of the volume specific resistivity and measured electric field as shown in FIG. 1 was obtained. In one example, the volume specific resistivity of the carrier at an electric field strength of 5000 V/cm was $10^{10}\Omega\cdot$cm.

Carrier B

| | (parts by weight) |
|---|---|
| Ferrite particle (average particle size 50 μm) | 100 |
| Toluene | 14 |
| Styrene-methyl methacrylate copolymer (copolymerization ratio = 20:40, critical surface tension 35 dyne/cm) | 1.0 |
| Perfluorooctylethyl methacrylate-methyl methacrylate copolymer (copolymerization ratio 40:60, critical surface tension 24 dyne/cm) | 0.5 |
| $SnO_2$ (tradename S-1, manufactured by Mitusbishi Material Corp., average particle size 20 nm, volume specific resistivity at an electric field strength of 1000 V/cm is $10^6\Omega\cdot$cm) | 0.6 |
| Cross-linked nylon resin particles (average particle size 0.3 μm, insoluble in toluene) | 0.2 |

The above-described components except the ferrite particle were dispersed for 30 minutes by a sand mill, and a solution for forming a resin-coated layer was prepared. Then, this solution for forming a resin-coated layer was charged together with the ferrite particles in a vacuum deaeration type kneader, stirred for 30 minutes at a temperature of 70° C., then the pressure was reduced to distill off toluene to obtain a carrier comprising ferrite particles having a resin-coated layer formed thereon. The volume specific resistivity of the resulting carrier was measured by the above-described measuring method, and a graph of the volume specific resistivity and the measured electric field as shown in FIG. 1 was obtained. In one example, the volume specific resistivity of the carrier at an electric field strength of 5000 V/cm was $10^{12}\Omega\cdot$cm.

Carrier C (low resistivity carrier)

| | (parts by weight) |
|---|---|
| Ferrite particle (average particle size 45 μm) | 100 |
| Toluene | 14 |
| Styrene-methyl methacrylate copolymer (copolymerization ratio = 20:40, critical surface tension 35 dyne/cm) | 1.3 |
| Carbon black (tradename: R330R, manufactured by Cabbot, average particle size 25 nm, DBP value 71 ml/100 g) | 0.6 |
| Ctoss-linked melamine resin particles (average particle size 0.3 μm, insoluble in toluene) | 0.2 |

The above-described components except the ferrite particles were dispersed for 30 minutes by a sand mill, and a solution for forming a resin-coated layer was prepared. Then, this solution for forming a resin-coated layer was charged together with the ferrite particles in a vacuum deaeration type kneader, stirred for 30 minutes at a temperature of 70° C., then the pressure was reduced to distill off toluene to obtain a carrier comprising ferrite particles having a resin-coated layer formed thereon. The volume specific resistivity of the resulting carrier was measured by the above-described measuring method, and a graph of the volume specific resistivity and the measured electric field as shown in FIG. 1 was obtained. In one example, the volume specific resistivity of the carrier at an electric field strength of 3000 V/cm was $10^8\Omega\cdot$cm.

Carrier D (high resistivity carrier)

| | (parts by weight) |
|---|---|
| Ferrite particle (average particle size 50 μm) | 100 |
| Toluene | 14 |
| Styrene-methyl methacrylate copolymer (copolymerization ratio = 20:40, critical surface tension 35 dyne/cm) | 1.8 |
| Cross-linked melamine resin particles (average particle size 0.3 μm, insoluble in toluene) | 0.2 |

A styrene-methacrylate copolymer was diluted with toluene and the solution was stirred with a stirrer for 10 minutes. Then, this resin solution, the crosslinked melamine resin particles, and the ferrite particles were charged in a vacuum deaeration type kneader, stirred for 30 minutes at a temperature of 70° C., then the pressure was reduced to distill off toluene to obtain a carrier comprising ferrite particles having a resin-coated layer formed thereon. The volume specific resistivity of the resulting carrier was measured by the above-described measuring method, and a graph of the volume specific resistivity and the measured electric field as shown in FIG. 1 was obtained. In one example, the volume specific resistivity of the carrier at an electric field strength of 10000 V/cm was $10^{13.5}\Omega\cdot$cm.

Production of Non-magnetic Resin Particles

Non-magnetic resin particles a

| | (parts by weight) |
|---|---|
| Polyester resin (synthesized from bisphenol A-ethylene oxide 2 adduct, bisphenol A-propylene oxide 2 adduct, terephthalic acid and trimellitic acid, Mw = 14000, Tg = 62° C., THF insoluble components 25%) | 87 |
| Carbon black (trade name: BPL manufactured by Cabbot Corp.) | 7 |
| Polypropylene wax (trade name: Viscol 660P manufactured by Sanyo Chemical Industry Ltd.) | 6 |

The above-described raw materials were pre-mixed, 3% of water was added by a biaxial extruder, and the mixture was melted and kneaded while maintaining the temperature of the kneaded material at 110° C., it was then roll-cooled, and pre-ground by a hammer mill and the like. Then, the material was finely ground by a jet mill, and fine and coarse particles were cut by an air classifier to produce non-magnetic resin particles having a volume average particle size of 9.3 μm. The volume average particle size was measured by a colter counter TA-II type (aperture diameter 100 μm). The value of tanδ was 6.

Non-magnetic resin particles b

| | (parts by weight) |
|---|---|
| Polyester resin (synthesized from bisphenol A-ethylene oxide 2 adduct, bisphenol A-propylene oxide 2 adduct, terephthalic acid and trimellitic acid, Mw = 14000, Tg = 62° C., THF insoluble components 25%) | 82 |
| Pigment red 57:1 | 4 |
| Polypropylene wax (trade name: Viscol 660Pmanufactured by Sanyo Chemical Industry Ltd.) | 6 |

The above-described raw materials were pre-mixed, 3% of water was added by a biaxial extruder, and the mixture was melted and kneaded while maintaining the temperature of the kneaded material at 110° C., it was then roll-cooled, and pre-ground by a hammer mill and the like. Then, the material was finely ground by a jet mill, and fine and coarse particles were cut by an air classifier to produce non-magnetic resin particle having a volume average particle size of 9.3 μm. The volume average particle size was measured by a colter counter TA-II type (aperture diameter 100 μm). The value of tanδ was 7.8.

Production of Titanium Oxide

Titanium Oxide 1

Figure 2:
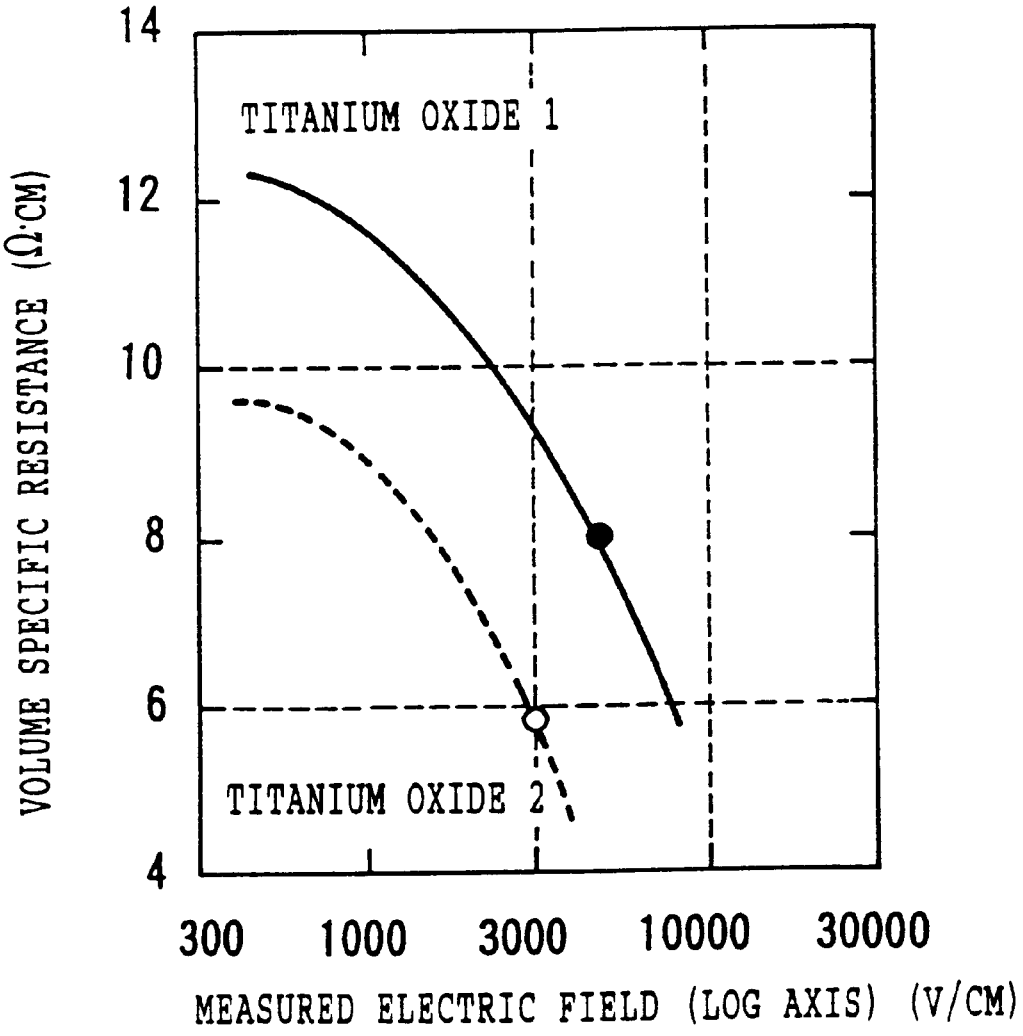
FIG. 2 is a graph showing the relation between the volume specific resistivity of titanium oxide and the measured electric field.

10 g of titanium oxide fine particles obtained by washing rutile type titanium oxide having an average particle size of 15 nm (trade name: MT-150 A manufactured by Teika Corp.) with water to reduce the amount of water-soluble components thereof to 0.11% by weight was added to a mixed solvent of methanol-water (95:5) in which 1.5 g of decyltrimethoxysilane had been dissolved, and the mixture was dispersed by ultrasonic wave. Then, methanol and the like in the dispersed solution were evaporated by an evaporator for drying, and the dried product was subjected to heat processing by a dryer set at 120° C., and ground in mortar to obtain titanium oxide the surface of which had been treated with decyltrimethoxysilane. The volume specific resistivity of the resulting titanium oxide was measured by the above-described measuring method, and a graph of the volume specific resistivity and the measured electric field as shown in FIG. 2 was obtained. In one example, the volume specific resistivity of the titanium oxide at an electric field strength of 5000 V/cm was $10^8\Omega\cdot$cm.

Titanium Oxide 2

(Low Resistivity Titanium Oxide)

10 g of titanium oxide fine particles obtained by washing rutile type titanium oxide having an average particle size of 15 nm (MT-150 A manufactured by Teika Corp.) with water to reduce the amount of water-soluble components thereof to 0.11% by weight was added to a mixed solvent of methanol-water (95:5) in which 0.2 g of decyltrimethoxysilane had been dissolved, and the mixture was dispersed by ultrasonic wave. Then, methanol and the like in the dispersed solution were evaporated by an evaporator for drying, and the dried product was subjected to heat processing by a dryer set at 120° C., and ground in mortar to obtain titanium oxide the surface of which had been treated with decyltrimethoxysilane. The volume specific resistivity of the resulting titanium oxide was measured by the above-described measuring method, and a graph of the volume specific resistivity and the measured electric field as shown in FIG. 2 was obtained. In one example, the volume specific resistivity of the titanium oxide at an electric field strength of 3000 V/cm was $10^{5.8}\Omega\cdot$cm.

Preparation of Electrostatic Latent Image Developer 4 separate mixes consisting of 100 parts by weight of each of the non-magnetic resin particles obtained as described above and 1.5 parts by weight of each of the titanium oxides were mixed using a Henschel mixer at 2000 rpm for 5 minutes, to obtain 4 separate toners.

Figure 3:
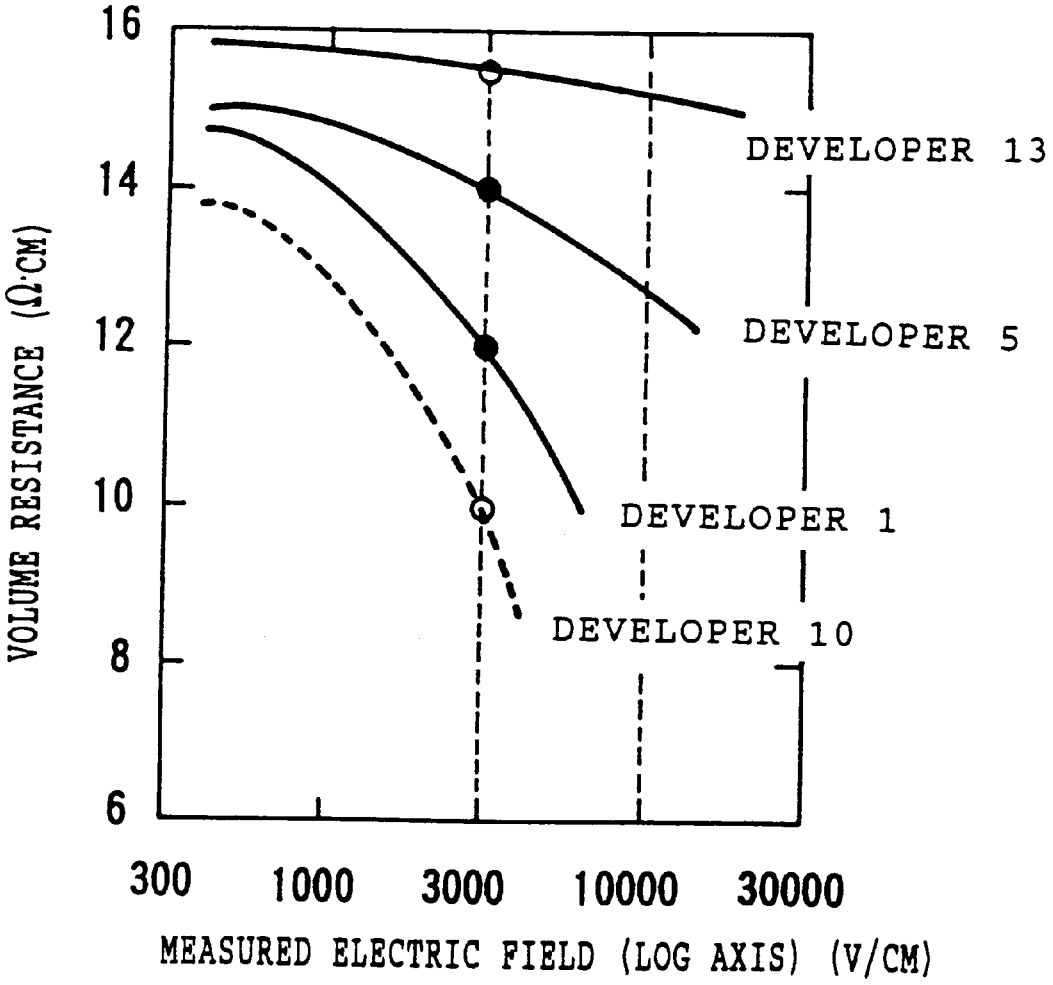
FIG. 3 is a graph showing the relation between the volume resistivity of an electrostatic latent image developer and the measured electric field.

16 separate mixes consisting of 7.0 parts by weight of each of the resulting toners and 100 parts by weight of each of the carriers obtained as described above were mixed at 20 rpm for 20 minutes by a V type blender, to prepare 16 separate types of electrostatic latent image developer. The volume specific resistivity of a part of the resulting electrostatic latent image developers was measured by the above-described measuring method, and a graph of the volume resistivities and the measured electric fields as shown in FIG. 3 was obtained.

Further, in order to measure the volume resistivity of the electrostatic latent image developer when the toner concentration is low, an electrostatic latent image developer having a toner concentration of 0.2% was prepared in the same manner.

Image Formation and Evaluation Thereof

Using these electrostatic latent image developers, copy tests of the initial copies and after 10,000 copies were conducted under conditions of medium temperature and medium humidity (22° C., 55% RH) using an electrophotography copying machine (tradename: A-color 630 manufactured by Fuji Xerox Co., Ltd.). The results are shown in Tables 1 and 2.

TABLE 1

| | | | | Initial quality of image | | Quality of image after 10,000 copies | | Volume resistivity of | |
|---|---|---|---|---|---|---|---|---|---|
| Carrier | Non-magnetic resin fine particle | Titanium oxide | Developer | Fogging on copy | Defect *1 | Fogging on copy | Defect *1 | developer *2 (Ω · cm) | Remarks |
| A | a | 1 | 1 | ○ | ○ | ○ | ○ | $10^{12}$ | Example |
| | | 2 | 2 | × | ○ | × | ○ | $10^{10.5}$ | Comparative example |
| | b | 1 | 3 | ○ | ○ | ○ | ○ | $10^{12.2}$ | Example |
| | | 2 | 4 | × | ○ | ×× | ○ | $10^{10.8}$ | Comparative example |
| B | a | 1 | 5 | ○ | ○ | ○ | ○ | $10^{14}$ | Example |
| | | 2 | 6 | × | ○ | × | ○ | $10^{13.5}$ | Comparative example |
| | b | 1 | 7 | ○ | ○ | ○ | ○ | $10^{14.5}$ | Example |
| | | 2 | 8 | × | ○ | ×× | ○ | $10^{14}$ | Comparative example |

*1: Defect in border region between half tone and solid image
*2: Value at a toner concentration of 2% and a measured electric field of 3000 V/cm

TABLE 2

| | | | | Initial quality of image | | Quality of image after 10,000 copies | | Volume resistivity of | |
|---|---|---|---|---|---|---|---|---|---|
| Carrier | Non-magnetic resin fine particle | Titanium oxide | Developer | Fogging on copy | Defect *1 | Fogging on copy | Defect *1 | developer *2 (Ω · cm) | Remarks |
| C | a | 1 | 9 | × | ○ | × | ○ | $10^{11}$ | Comparative example |
| | | 2 | 10 | ×× | ○ | ×× | ○ | $10^{10}$ | Comparative example |
| | b | 1 | 11 | × | ○ | × | ○ | $10^{12}$ | Comparative example |
| | | 2 | 12 | ×× | ○ | ×× | ○ | $10^{10.5}$ | Comparative example |
| D | a | 1 | 13 | ○ | × | ○ | ×× | $>10^{15}$ | Comparative example |
| | | 2 | 14 | × | ×× | × | ×× | $>10^{15}$ | Comparative example |
| | b | 1 | 15 | ○ | × | × | ×× | $>10^{15}$ | Comparative example |
| | | 2 | 16 | × | ×× | × | ×× | $>10^{15}$ | Comparative example |

*1: Defect in border region between half tone and solid image
*2: Value at a toner concentration of 2% and a measured electric field of 3000 V/cm The extents of the fogging and the defects in the border region between the half tone and the solid image were evaluated by visually observing the copies and were judged as follows.

○: no fogging, or no defects

X: slight fogging, or slight defects

XX: marked fogging, or marked defects

In electrostatic latent image developers 1, 3, 5, 7 of the examples, there was generally no fogging or defects in the border regions between the half tone and the solid image, and stable images were obtained. Further, there was no change in the image quality after 10,000 copies as compared with the initial image quality, therefore, image quality stability after a lapse of time was also confirmed.

What is claimed is:

1. An electrostatic latent image developer including a toner, which is formed from an outer additive and non-magnetic resin particles containing a binder resin and a coloring agent, and a carrier, in which a resin coating layer in which electroconductive fine powder is dispersed in a matrix resin is formed on a core material, wherein the amount of coating resin of said resin coating layer is not less than 1.0 part by weight based on 100 parts of the core material, and wherein a volume specific resistivity of said carrier is greater than or equal to $10^9$ Ω·cm at an electric field strength of 10000 V/cm, said outer additive contains titanium oxide whose volume specific resistivity of a compression-molded molded product is greater than or equal to $10^6$ Ω·cm at an electric field strength of 3000 V/cm and is less than or equal to $10^{10}$ Ω·cm at an electric field strength of 10000 V/cm, and a volume specific resistivity of said electrostatic latent image developer when a toner concentration is greater than or equal to 2% is greater than or equal to $10^{11}$ Ω·cm at an electric field strength of 3000 V/cm; and wherein the amount of the coating resin of said resin-coating layer is not more than 15 parts by weight based on 100 parts by weight of the core material.

2. An electrostatic latent image developer according to claim 1, wherein the amount said titanium oxide is from 0.2 parts by weight to 3.0 parts by weight based on 100 parts by weight of said non-magnetic resin particle.

3. An electrostatic latent image developer according to claim 1, wherein said coloring agent is carbon black.

4. An electrostatic latent image developer according to claim 3, wherein the amount of said carbon black is from 2 to 10% by weight of non-magnetic resin particles.

5. An electrostatic latent image developer according to claim 1, wherein the value of the dielectric loss tangent tanδ of said non-magnetic resin particles is from 3 to 15.

6. An electrostatic latent image developer according to claim 1, wherein said resin-coating layer further contains resin fine particles.

7. An electrostatic latent image developer according to claim 1, wherein resin fine particles are further dispersed in said matrix resin and the resin fine particles are comprised of a resin containing nitrogen atoms.

8. An electrostatic latent image developer according to claim 1, wherein resin fine particles are further dispersed in said matrix resin and the resin fine particles are comprised of a thermosetting resin.

9. An electrostatic latent image developer according to claim 1, wherein resin fine particles are further dispersed in said matrix resin and the resin fine particles are composed of a thermosetting resin containing nitrogen atoms.

10. An electrostatic latent image developer according to claim 1, wherein said electroconductive fine particles are carbon black.

11. An electrostatic latent image developer according to claim 1, wherein said binder resin comprises a polyester containing THF insoluble components in an amount ranging from 5 to 30%.

12. An image forming method including steps of forming a latent image on a latent image holding member, and developing the latent image by using the electrostatic latent image developer of claim 1.

13. An image forming method according to claim 12, wherein the amount said titanium oxide is from 0.2 parts by weight to 3.0 parts by weight based on 100 parts by weight of said non-magnetic resin particles.

14. An image forming method according to claim 12, wherein said coloring agent is carbon black.

15. An image forming method according to claim 12, wherein the amount of said carbon black is from 2 to 10% by weight of non-magnetic resin particles.

16. An image forming method according to claim 12, wherein the value of tanδ of said non-magnetic resin particles is from 3 to 15.

17. An image forming method according to claim 12, wherein said resin-coating layer further contains resin fine particles.

18. An image forming method according to claim 17, wherein resin fine particles are further dispersed in said matrix resin and the resin fine particles are comprised of a resin containing nitrogen atoms.

19. An image forming method according to claim 17, wherein resin fine particles are further dispersed in said matrix resin and the resin fine particles are comprised of a thermosetting resin.

* * * * *